US006564514B1

(12) United States Patent
Rickards

(10) Patent No.: US 6,564,514 B1
(45) **Date of Patent: *May 20, 2003**

(54) CONCEALED SLAB FASTENER

(76) Inventor: John W. Rickards, 1055 Santa Barbara St., San Diego, CA (US) 92107

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/360,023

(22) Filed: Jul. 23, 1999

Related U.S. Application Data

(63) Continuation-in-part of application No. 08/958,623, filed on Oct. 27, 1997, now Pat. No. 5,953,865.

(51) Int. Cl.[7] ..... E04H 13/00

(52) U.S. Cl. ..... 52/139; 52/509; 52/512; 52/137

(58) Field of Search ..... 52/139, 512, 235, 52/504, 506.01, 506.05, 506.06, 263, 137

(56) References Cited

U.S. PATENT DOCUMENTS 3,181,664 A * 5/1965 Aagaard ..... 52/509 X
3,778,942 A * 12/1973 Bondi ..... 52/134
3,828,508 A * 8/1974 Moeller ..... 52/509 X
3,905,169 A * 9/1975 Gallo ..... 52/137
3,990,199 A * 11/1976 Gallo ..... 52/137
4,021,989 A * 5/1977 Hala ..... 52/713
4,190,157 A * 2/1980 Chatham ..... 206/477
4,519,173 A * 5/1985 Roberts ..... 52/509 X
4,523,413 A * 6/1985 Koppenberg ..... 52/139
4,545,167 A * 10/1985 Brock ..... 52/509
4,638,618 A * 1/1987 Iesaka et al. ..... 52/509
4,644,711 A * 2/1987 Eickhof ..... 52/127.11
4,724,643 A * 2/1988 Marsh ..... 52/509
4,803,823 A * 2/1989 Stenson ..... 52/506
5,138,809 A * 8/1992 Saikachi ..... 52/235
5,280,690 A * 1/1994 Hu ..... 52/513
5,419,091 A * 5/1995 Roberts ..... 52/509
5,894,699 A * 4/1999 Fulton et al. ..... 52/132
5,953,865 A * 9/1999 Richards ..... 52/139

* cited by examiner

*Primary Examiner*—Daniel P. Stodola
*Assistant Examiner*—Khoa Tran
(74) *Attorney, Agent, or Firm*—Henri J. A. Charmasson; John D. Buchaca

(57) ABSTRACT

A device for releasably fastening a cover slab to the opening of a crypt or niche extending back from a vertical support wall. Each device is positioned at a common point of adjacency of a plurality of slabs. Each device has a rotatively mounted locking plate for engaging slots in the sides of each of the slabs. The plate has a cutaway sized and dimensioned to allow for the passage of one of the slabs through the cutaway when the cutaway is rotated into proper alignment. A keyed tool may be used for turning the plate indicating the positioning of the cutaway. The plate is mounted to allow minor axial, pitch and yaw movement and is biased toward an axially perpendicular orientation.

11 Claims, 6 Drawing Sheets

CONCEALED SLAB FASTENER

PRIOR APPLICATION

This is a continuation-in-part of copending U.S. patent application Ser. No. 08/958,623 filed Oct. 27, 1997 now U.S. Pat. No. 5,953,865, fully incorporated herein by this reference and in which priority is hereby claimed.

FIELD OF THE INVENTION

This invention relates to mechanical support structures and more particularly to structures for releasably hanging niche and crypt slabs in mausoleums.

BACKGROUND OF THE INVENTION

Most societies have created facilities or repositories such as cemeteries and mausoleums for interring the bodily or cremated remains of persons after death. Remains are often kept in openable chambers set into vertical support walls. Larger chambers, often called crypts are dimensioned to inter bodily remains, while smaller chambers, often called niches are sized to inter cremated remains. To save space, the chambers are often rectangular and arranged in row and column fashion along a single vertical wall. The chamber openings are typically covered by a rectangular block or slab. It is fashionable to use heavy, ornate, rock-based materials such as marble, granite or slate for the slabs.

Because a particular slab must occasionally be removed in order to access or add to the contents of a chamber, the slab is releasably hung or attached over the opening to the chamber using a plurality of slab fasteners.

Various slab fasteners have been developed. One popular approach is described in Gallo, U.S. Pat. No. 3,905,169 utilizing horizontal shelving plates for supporting the weight of the slab while a four removable screw-based rosettes placed at the corners prevent forward movement of the slab. This approach offers some disadvantages including wear or discoloration of the visible forward face of the slab surrounding the rosette. Further, removal of the screw-based rosettes is time-consuming. Since a single rosette can fasten the corners of four corner-adjacent slabs, removal of a rosette can cause an unwanted disruption of the fastening of adjacent slabs.

A move toward hidden means for attachment has been gathering popularity. This allows the outer face of the slab to remain unencumbered or potentially damaged by visible attachment means. One example, disclosed in Hala, U.S. Pat. No. 4,021,989 has a laterally adjustable disc-shaped stone anchor which engages lateral slots machined into the sides of the slab. This design suffers from the problematic securing of closely adjacent slabs, and the penetrative machining of the slots. Another example, disclosed in Hu, U.S. Pat. No. 5,280,690 uses rearwardly extending resilient prongs secured to the back of the slab which releasably penetrate holes in a receptor set into the forward face of the support wall. This design suffers from likely inadequate support for heavier slabs, precise placement of the prongs, and awkward removal.

It has been found that due to the heaviness of the slabs and required ruggedness of the fasteners, precise placement of the fasteners is needed. However, slabs are often made with less than exacting tolerances. Therefore, there is a need for a rugged fastener which allows greater leeway in placement of slabs.

The invention results from an attempt to develop a hidden slab fastener which reduces or avoids the above identified disadvantages.

SUMMARY OF THE INVENTION

The principal and secondary objects of this invention are to provide an inexpensive durable and hidden slab fastener which provides adequate support, requires a minimum of slab machining, maintains the fastening of adjacent slabs during removal of a slab, and allows for more rapid and simplified removal and replacement of a slab. It is another object of the invention to provide means for indicating the locking condition of a hidden fastener.

These and other valuable objects are provided by a slab fastener comprising a rotatively mounted locking plate located at a common point of adjacency between a plurality of adjacent slabs. The plate is oriented coplanar with the slabs, and sized to engage a slot in the corner sides of each of the slabs. The plate has a cutaway sized and dimensioned to allow for the passage of one of the slabs through the cutaway when the cutaway is rotated into proper alignment. Keyed tool means for turning the plate indicate the positioning of the cutaway. The lock plate can be mounted in a spring loaded fashion to allow minor axial, pitch and yaw movement of the plate during placement and removal of the slab.

DESCRIPTION OF THE PREFERRED EMBODIMENT OF THE INVENTION

Figure 1:
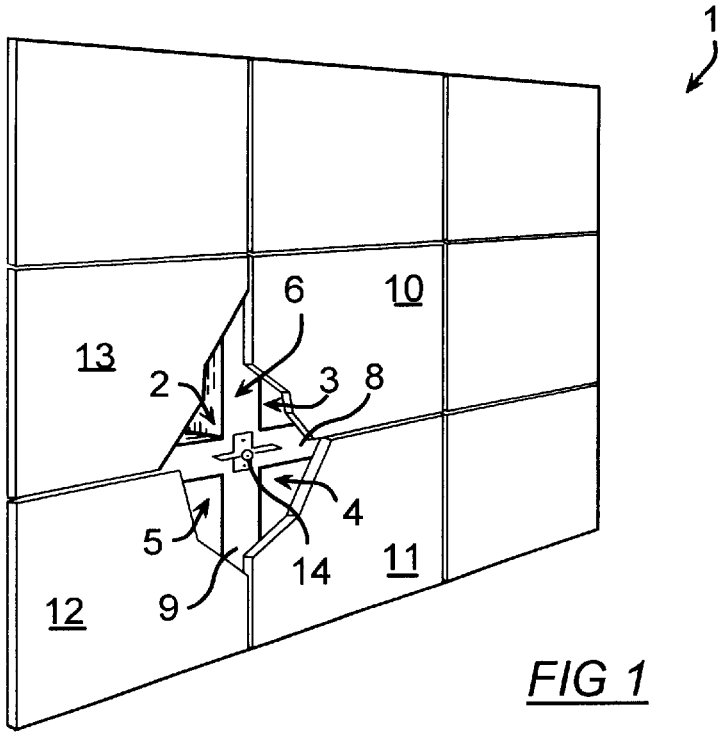
FIG. 1 is a diagrammatic perspective view of a plurality of internment chambers and cover slabs arranged on a vertical support wall.
Figure 2:
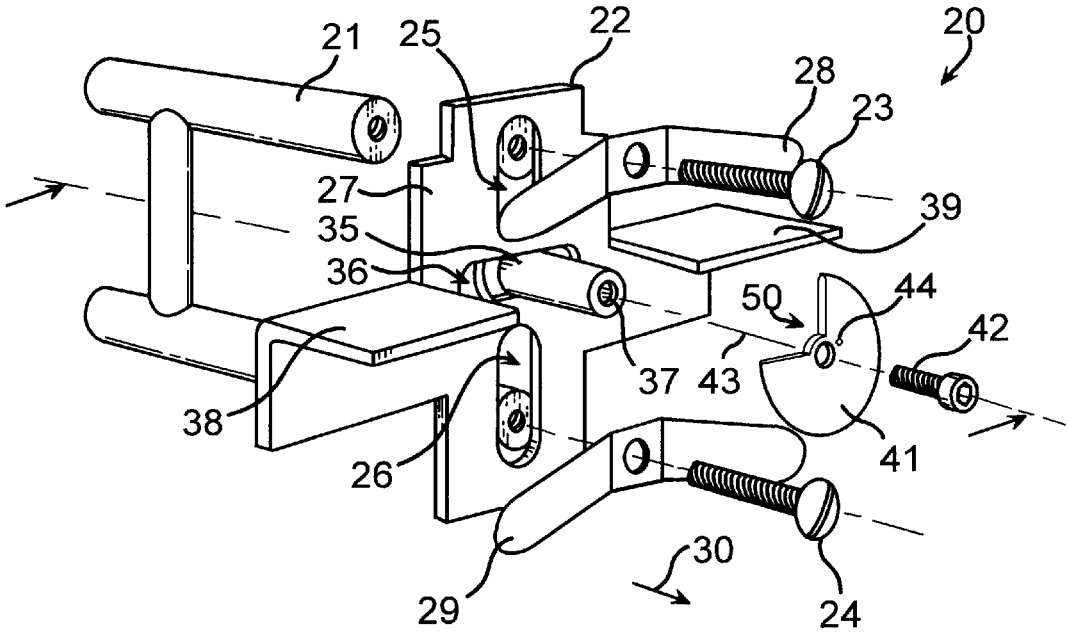
FIG. 2 is an exploded perspective view of a slab fastener according to the invention.
Figure 3:
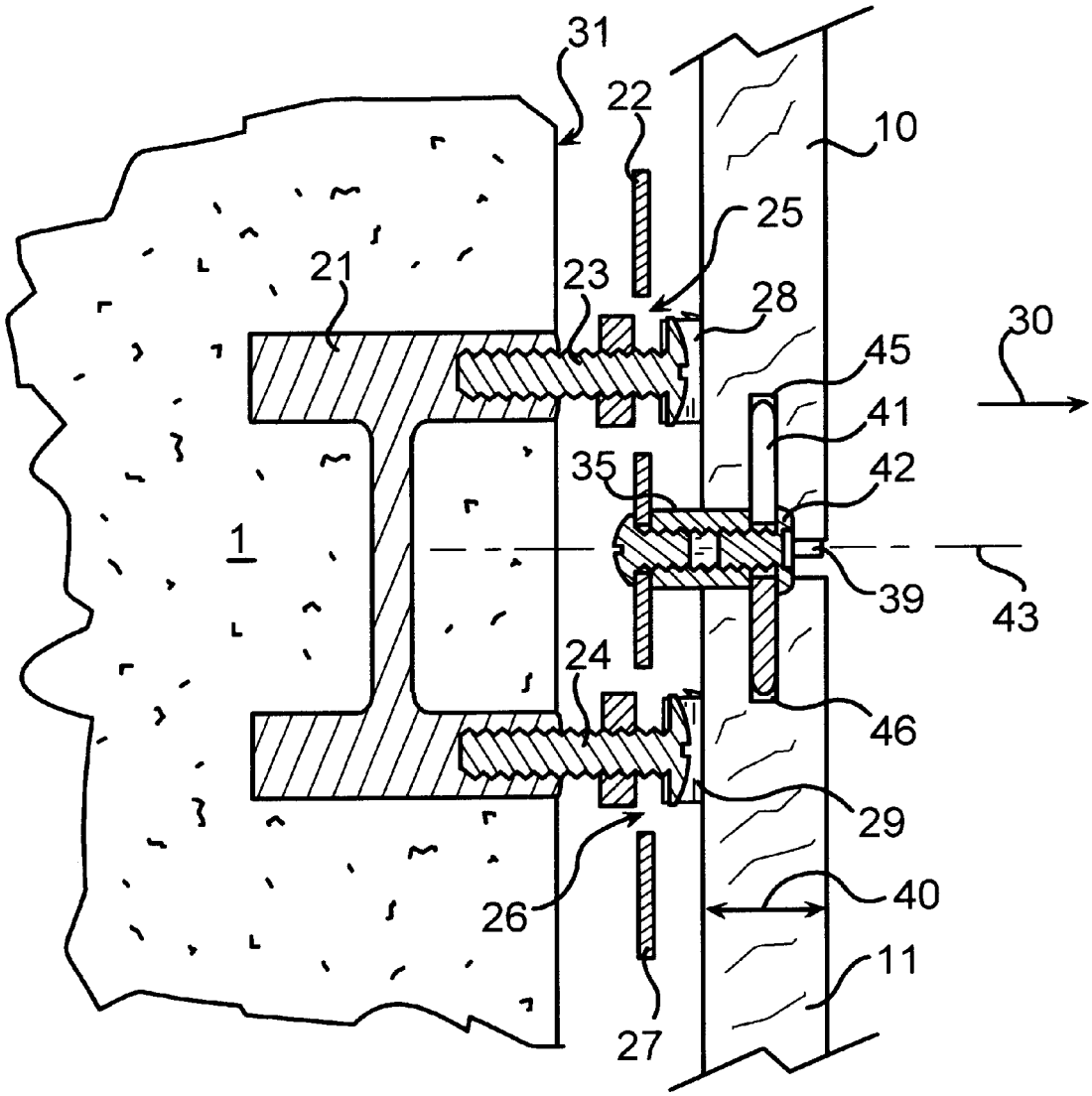
FIG. 3 is a cross-sectional side view of an in-use slab fastener.

Referring now to the drawing, there is shown in FIG. 1 a stationary vertical support structure or wall 1 having a number internment chambers 2, 3, 4, 5 arranged in a roll-and-column fashion divided by a network of horizontal floors 8 and vertical sidewalls 9. Each box-shaped chamber extends horizontally back from the front face 6 of the wall.

Each chamber is covered by a rectangular slab cover 10,11,12,13 made from marble, granite, slate, metal, plastic or other rigid durable sheet material. Each rectangular cover slab is releasably attached to the face of the support structure via slab fasteners placed at its four corners.

A single fastener is located at a point 14 of common adjacency between four corner-adjacent slabs 10–13. In this specification the term "corner-adjacent" is meant to include diagonal adjacency as between slabs 10 and 12, as well as side-by-side, or up-and-down adjacency as in slabs 10 and 11. A single fastener therefore may support a portion of four commonly adjacent slabs.

Referring now to FIGS. 2–6, there is shown a slab fastener 20 for fastening four corner-adjacent rectangular slabs at a common point of adjacency or their four common corners. The fastener comprises an anchor 21 for essentially permanent attachment into the masonry of vertical wall 1 defining the internment chambers. A hanger member 22 made of strong, durable non-corroding material such as brass is semi-permanently attached to the anchor via screws 23,24 through oblong apertures 25,26 in a vertical backing 27, allowing for minor adjustments in the fastener's positioning with respect to the wall. Slab springs 28,29 which serve to bias fastened slabs outward 30 away from the wall, thereby facilitating slab removal, are optionally attached to the hanger member by the screws.

The vertical backing 27 of the hanger member 22 is oriented parallel to the front face 31 of the vertical wall when attached. The backing also supports a central, substantially cylindrical post 35 extending outward perpendicular to the backing. The post has a rear end attached to the backing though a laterally oblong aperture 36 allowing minor lateral adjustment of the point of common adjacency. The post's lateral and vertical location defines the intended point of the common adjacency. The post has a threaded central bore 37 extending rearward from a forward end.

A pair of coplanar support shelves 38,39 extend forward perpendicularly from the backing 27 straddling the post 35. The shelves are located to support the lower sides of the two upper adjacent mounted slabs 13,10. Therefore the plane of the shelves substantially passes through the point of adjacency of the four mounted slabs. The front-to-back dimension of the shelves is less than the thickness 40 of the slabs so as to remain hidden when the slabs are mounted.

A locking plate 41 in the form of a radially eccentric disk made of strong, rigid material such as brass, or stainless steel is rotatively mounted between the support shelves 38,39 on the forward end of the post 35 via an attachment screw 42 engaging the central bore 37. The plate's axis 43 of rotation is therefore coaxial with the bore, and its location is coplanar with the slabs. Therefore, the length of the post, measured forward to rear is less than the thickness of the slabs, thereby positioning the lock plate between the front and back surfaces of the plate.

The plate is sized and located to engage slots 45–48 extending into the sides of each slab at the corners. The slots may be of various shapes, for example rectangular 45,46, triangular 47, and semi-circular 48, so long as they allow for an amount of angular movement of the plate therein.

The disk has a cutaway 50 sized and dimensioned to allow for the passage of the corner of one of the slabs through the cutaway when the cutaway is rotated into the proper angular orientation. In this way, the disk may be said to be radially eccentric, i.e. the radial distance 51 from the axis 43 out to the edge 52 taken in a first angular direction is different from the distance 53 taken in a different angular direction.

In the preferred approach, the cutaway is substantially semi-circular in shape and is formed by substantially mutually orthogonal sides of the plate forming the cutaway. This shape allows for the substantially rectangular corner of a slab to pass therethrough.

Figure 4:
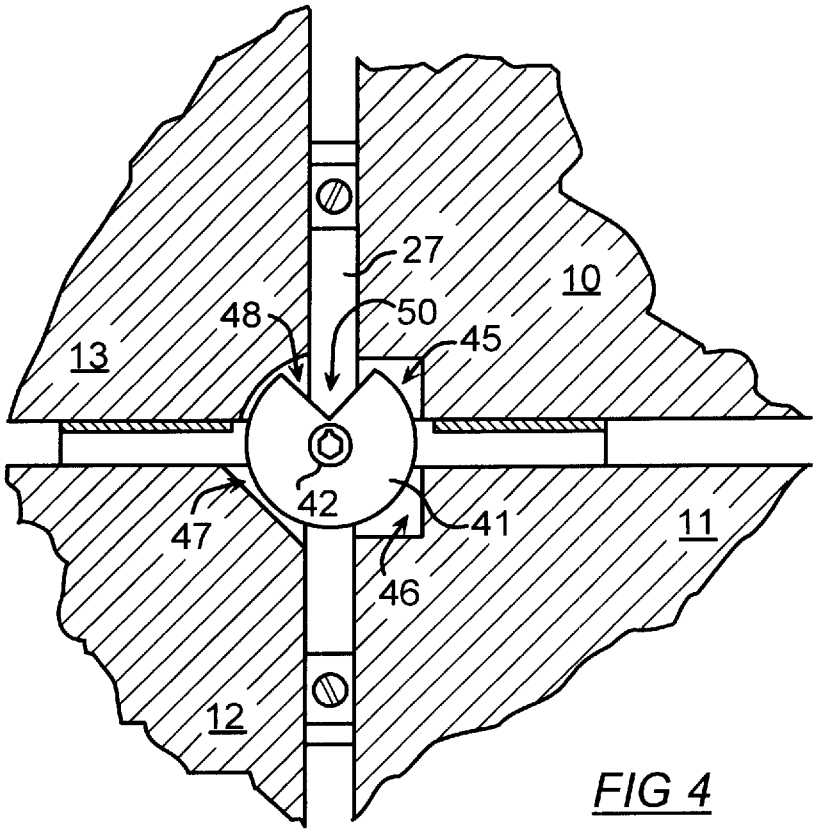
FIG. 4 is a cross-sectional front view of an in-use slab fastener wherein the lock plate is oriented to secure all adjacent slabs.
Figure 5:
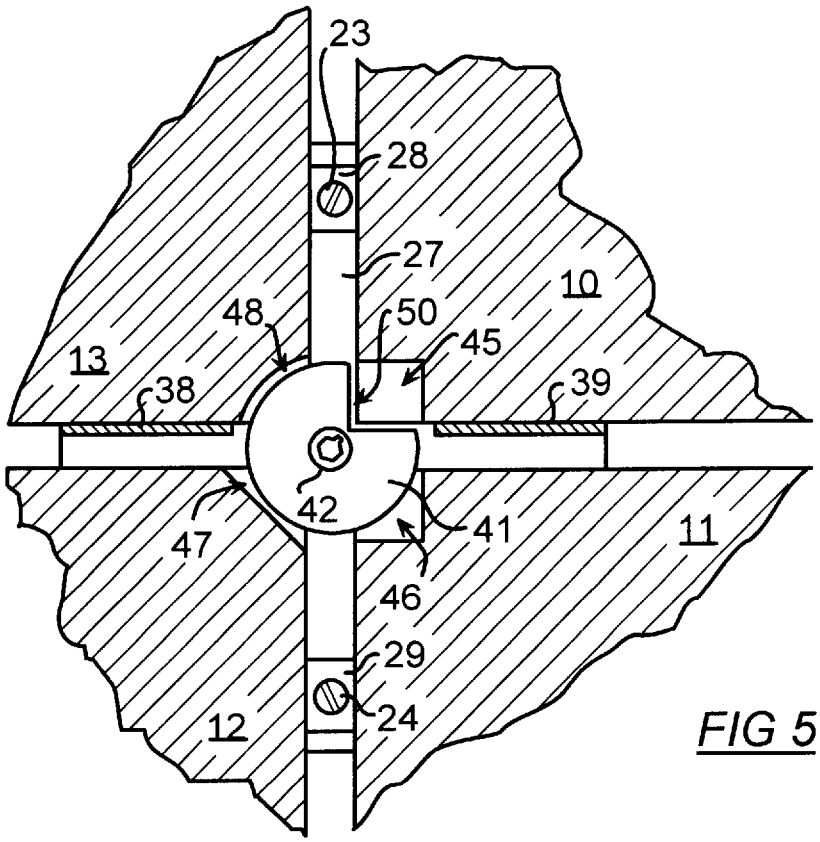
FIG. 5 is a cross-sectional front view of an in-use slab fastener wherein the lock plate is oriented to allow axial removal of a single slab.

A first angular orientation of the plate with respect to the slabs is shown in FIG. 4, where portions of the plate engage the slots of all four slabs preventing axial movement of the slabs. A second angular orientation, shown in FIG. 5, the cutaway 50 is aligned with slab 10 so that no portion of the plate is engaged into slot 45. This allows for the axial passage of the corner of slab 10 through the cutaway and hence, the removal of slab 10.

The screw 42 has an off-axis rearwardly protruding nib sized and located to engage a divot 44 on the front of the disk to provide adequate friction to allow for rotation of the plate by turning the screw. Other means common in the art may be used to rotatively mount the plate on the hanger member, and allow for manipulation of the angular orientation of the plate.

Figure 6:
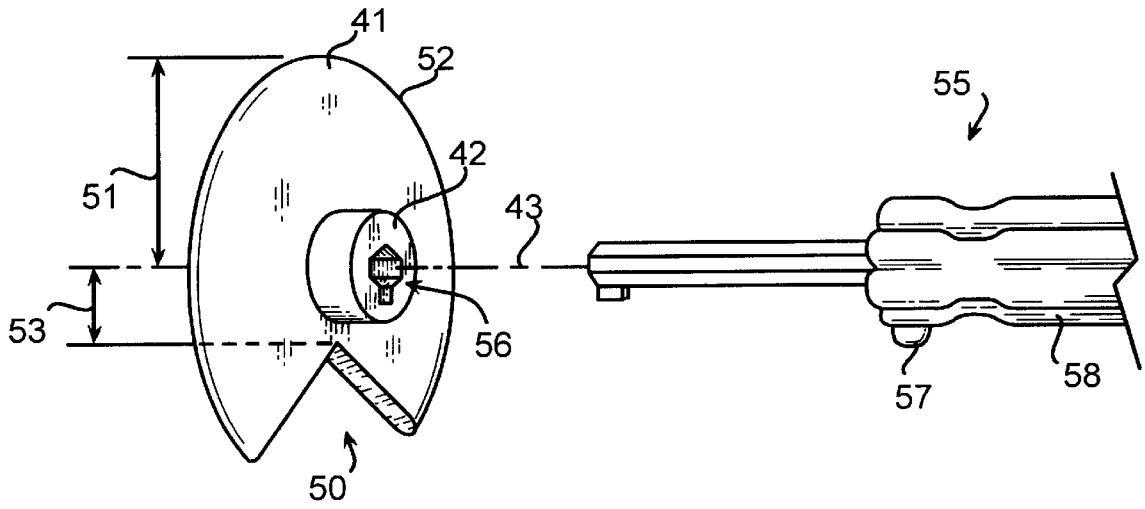
FIG. 6 is a perspective view of the keyed tool for rotating the lock plate while indicating angular orientation.

Referring now to FIG. 6, although a screwdriver or allen-wrench may be used to rotate the plate, the preferred approach uses a keyed tool 55 which engages the keyed hole 56 in the screw 42 in only one angular orientation. An indication in the form or a bump 57 on the handle 58 of the tool signifies the angular orientation of the plate 41.

Figure 7:
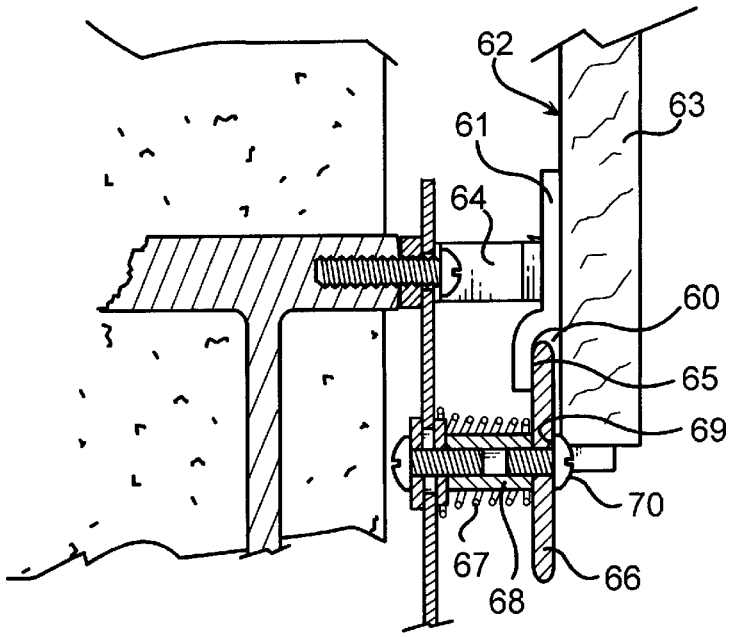
FIG. 7 is a cross-sectional side view of an alternate embodiment in-use slab fastener wherein the slab slots are formed by brackets attached to the back surface of a slab.

In an alternate embodiment of the fastener is shown in FIG. 7 where a slab slot 60 is formed by a bracket 61 attached to the back 62 of a slab 63. In general, the thickness of the slab slots are preferably commensurate with the thickness of the lock plate to maintain front-to-back positioning of the slabs. However, this is not always critical. The slab springs 64 may provide some positioning by forcing the rear face of the slot against the rear surface 65 of the plate 66.

Further, a plate spring 67 concentrically mounted around the post 68 provides for adequate engagement of the screw nib 69 when a simple threaded screw 70 is used to mount the plate 66. This spring also resists angular movement of the plate.

Figure 8:
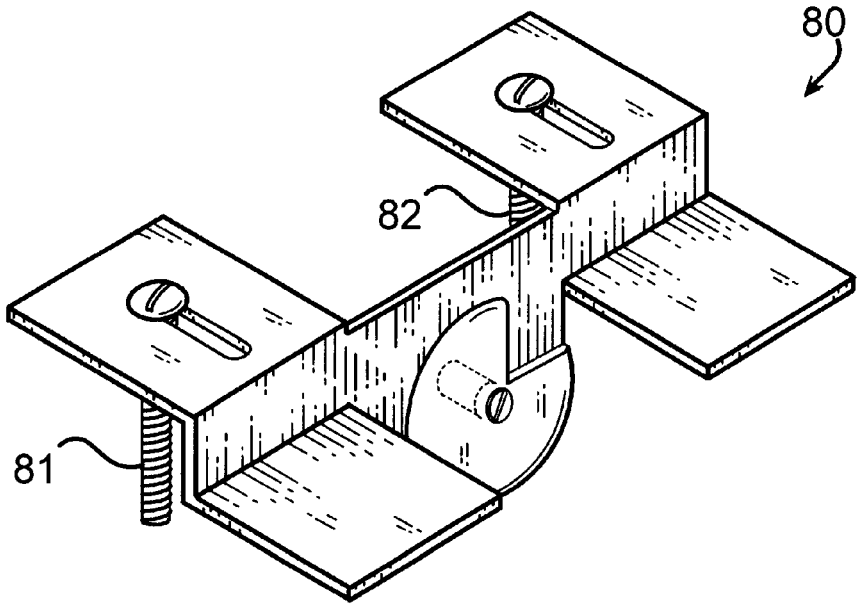
FIG. 8 is a perspective view of an alternate embodiment of the invention adapted to mounting on the top and bottom surfaces of a vertical support wall.
Figure 9:
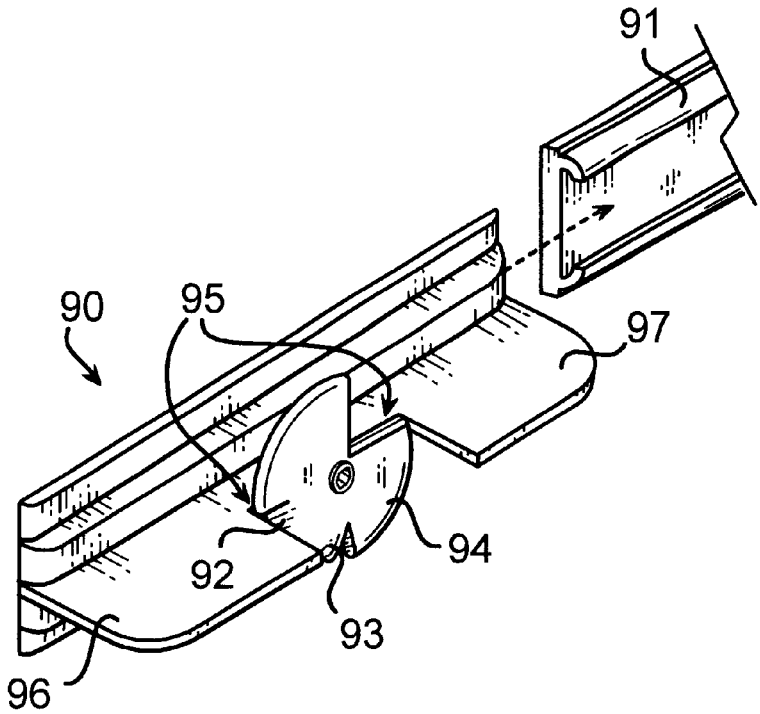
FIG. 9 is a perspective view of an alternate embodiment of the invention adapted to rail based fasteners.

Referring now to FIGS. 8–9, the invention is easily adapted to other fastener designs well known in the art. In FIG. 8, there is shown a fastener 80 according to the invention for securing slabs along the floor and ceiling of the vertical support wall where screws 81,82 engage an anchor extending from a top or bottom ledge.

FIG. 9 shows a fastener 90 according to the invention adapted for use in sliding rail based fastening systems where fasteners are slid into place on C-shaped cross-section tracks 91 mounted to the support wall. In addition, this embodiment shows that portions 92,93 of the plate 94 are bent rearward to form an end-stop to prevent angular movement of the disk beyond two ranges. The bent portions contact sections 95 integral with the slab supporting shelves 96,97. This embodiment of course cannot positively secure more than two side-adjacent slabs.

Figure 10:
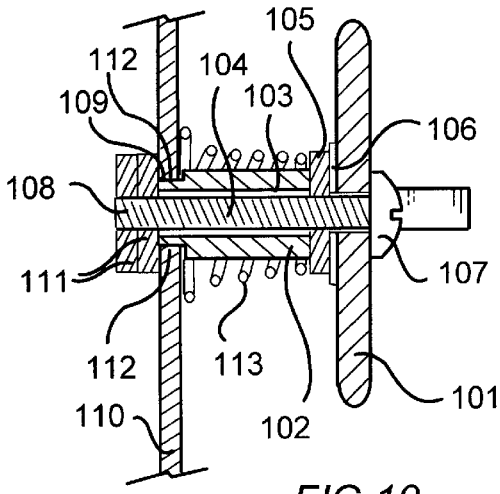
FIG. 10 is a cross-sectional side view of an alternate embodiment spring biased rotatable plate mounting means of the invention.

FIG. 10 shows an embodiment similar to the fastener of FIG. 7 with changes which allow minor axial, pitch and yaw movement of the lock plate 101. In particular, a generally cylindrical post 102 has a central bore 103 sized to allow free rotation of a threaded plate mounting bolt 104 therein without engaging the bolt's threads. In this embodiment the plate 101 is firmly, but if necessary, releasably mounted to the threaded bolt 104 by means of a nut 105 and lock washer 106. The bolt is sized and oriented to have its head 107 face forward allowing access for a screwdriver for driving plate rotation, and its opposite end 108 extend through the bore and through the laterally oblong aperture 109 in the vertical backing 110 of the fastener. The end 108 is engaged by a pair of nuts 111 to prevent extraction of the bolt during rotation of the plate. The bolt, plate, nuts and washer move as an integral unit during rotation of the plate in relation to and independent from the post and vertical backing. In this way the axial position of the plate can remain stationary after numerous turns of the plate. This would not occur if the bolt engages threads in the post.

In this embodiment, the post 102 diameter is sized large than the vertical dimension of the laterally oblong aperture 109 in the vertical backing. However, at its rear end the post has two horizontal parallel notches 112 set into opposite sides of its outer surface which allows insertion into the laterally oblong aperture. The notches are slightly oversized to allow minor pitch and yaw movement of the post/bolt/plate in relation to the stationary backing 110. A spring 113 concentrically placed around the outer surface of the post is sized to be under compression and exert a biasing force tending to push the plate 101 away from the backing 110. This force also tends to resist rearward axial and angular movement of the plate, as well as the minor pitch and yaw movement of the post. The allowable pitch movement is preferably less than about 10 degrees, and the yaw movement less than about 15 degrees.

Figure 11:
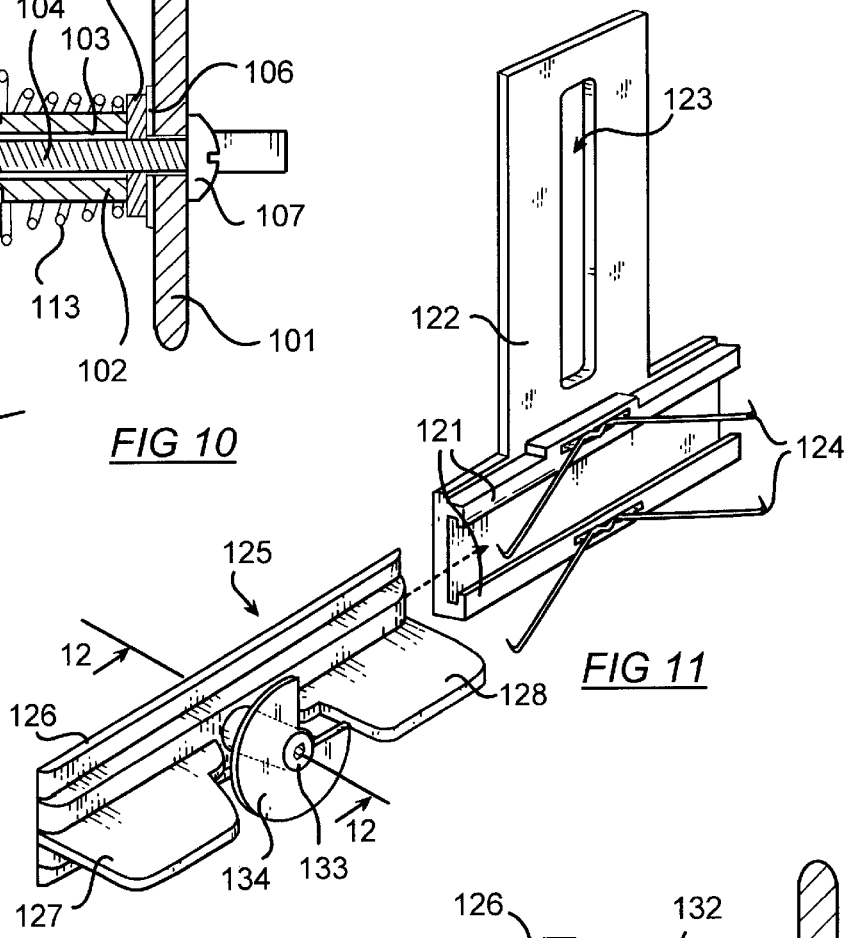
FIG. 11 is a perspective view of an alternate embodiment of the spring biased rotatably mounted lock plate adapted to rail based fasteners.
Figure 12:
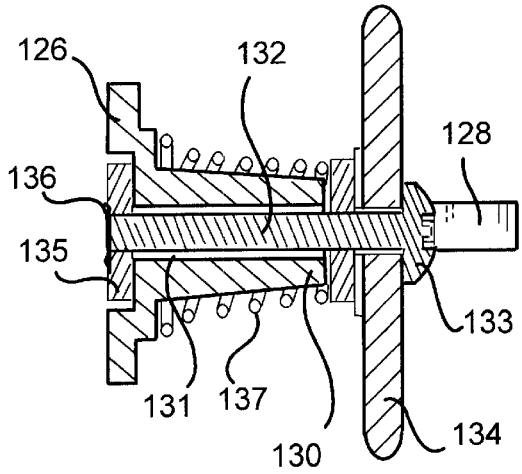
FIG. 12 is a cross-sectional side view of the fastener of FIG. 11 taken along line 12—12.

In an alternate embodiment, FIGS. 11 and 12 show a crypt-type fastener adapted for use in sliding rail based fastening systems. Generally C-shaped cross-section tracks 121 are formed into the forward surface on a lower portion of a hanger member 122. The upper portion of the hanger member has a vertically oblong aperture 123 for allowing vertically adjustable attachment to a wall. A pair of wire slab springs 124 are mounted to the hanger member above and below the tracks 121.

The rail member 125 has a vertical backing 126 sized to slide between the tracks 121. Two orthogonal slab supporting shelves 127,128 extend forward from the backing and straddle an orthogonally and forward projecting integral post 130 having a central bore 131 through which passes a bolt 132 having a head end 133 mounting a radially eccentric lock plate 134 and an opposite end upon which is threaded a nut 135 preventing extraction of the bolt from the bore. The rear interface 136 between the nut and the bolt has been damaged to prevent unscrewing of the nut. The size relationship between the length and diameter of the bolt shaft and the diameter of the central bore 131 are selected to allow minor pitch and yaw movement of the bolt/plate in relation to the post 130.

As in the previous embodiment, a spring 137 is placed concentrically about the post and is sized to be under compression. The force of the spring tends to resist rearward axial and angular movement of the bolt/plate, as well as minor pitch and yaw movement of the bolt/plate. Therefore, the plate is biased to have its axis of rotation be substantially perpendicular to the vertical backing. The allowable pitch and yaw movement is preferably less than about 10 degrees.

Although the preferred embodiment shows a fastener for use with four corner adjacent slabs, it is clear to those skilled in the art that minor modifications may be desirable for slabs located at the edge 13 or corner 12 of the wall, as shown in FIG. 1, where a particular corner of a slab may have adjacency with only one other slab, or no adjacency at all. These modifications are discussed in Gallo, U.S. Pat. No. 3,905,169.

Although the preferred embodiment is described with reference to rectangular slabs, it is clear to those skilled in the art that the invention can be adapted to slabs having various other geometrical shapes such as hexagonal.

Although the preferred embodiment allows for total rotational freedom of the plate within the slots, modification of the shape of the plate and/or slots may provide for angular end-stops without departing from the invention.

While the preferred embodiments of the invention have been described, modifications can be made and other embodiments may be devised without departing from the spirit of the invention and the scope of the appended claims.

What is claimed is:

1. A device for releasably fastening a cover portion of each of a plurality of corner-adjacent cover slabs to a vertical support wall comprises:

a lock plate rotatively and pitch and yaw movably mounted in relation to said wall and sized to engage a slot in each of said slabs;

wherein said plate is radially eccentric having a notched disk shaped and positioned to engage and disengage said slot according to an angular orientation of said plate.

2. The device of claim 1, which further comprises, an angular orientation indicator associated with said lock plate.

3. The device of claim 2, wherein said indicator comprises: a keyed slot angularly associated with said lock plate.

4. The device of claim 1, which further comprises:

a post axially projecting a distance out from said device, terminating at a distal end; and, said plate being rotatively mounted upon said distal end.

5. The device of claim 1, which further comprises:

a spring bearing against a back surface of said plate thereby axially biasing said plate away from said wall.

6. In a device for releasably fastening corner-adjacent portions of each of four cover slabs to a vertical support wall, wherein each of said portions has an edge slot associated therewith; an improvement which comprises:

a rotatively and pitch and yaw movably mounted lock plate sized and shaped to simultaneiously engage a plurality of said slabs;

said plate axially positioned to engage all of said slots while said plate is in a first angular orientation, and disengage a first one of said slots in a second angular orientation.

7. The improvement of claim 6, wherein said plate has a third angular orientation which disengages a second one of said slots, a fourth angular orientation which disengages a third one of said slots, and a fifth angular orientation which disengages a fourth one of said slots.

8. The improvement of claim 7, wherein said plate has an axis of rotation and is axially biased perpendicular to the plane of the wall.

9. A device for releasably securing a cover slab over the lateral opening of a chamber set into a substantially vertical wall, said device comprises:

a hanger member having a rotatively and pitch and yaw movably mounted lock plate having an axis of rotation; and an angular orientation indicator associated with said lock plate.

10. The device of claim 9, which further comprises:

a post axially projecting a distance out from said member, terminating at a distal end; and, said plate being rotatively mounted upon said distal end.

11. The device of claim 9, wherein said indicator comprises: a keyed slot angularly associated with said plate.

* * * * *